United States Patent [19]

Krishnakumar et al.

[11] 4,108,324

[45] Aug. 22, 1978

[54] RIBBED BOTTOM STRUCTURE FOR PLASTIC CONTAINER

[75] Inventors: Suppayan M. Krishnakumar, Attleboro, Mass.; Siegfried S. Roy, Amherst, N.H.; John F. E. Pocock, Nashua, N.H.; Salil K. Das, Amherst, N.H.; Gautam K. Mahajan, Nashua, N.H.

[73] Assignee: The Continental Group, Inc., New York, N.Y.

[21] Appl. No.: 799,635

[22] Filed: May 23, 1977

[51] Int. Cl.[2] ..... B65D 1/02

[52] U.S. Cl. ..... 215/1 C; 220/70

[58] Field of Search ..... 215/1 C; 220/66, 70, 220/69, 71, 72

[56] References Cited

U.S. PATENT DOCUMENTS

| | | | |
|---|---|---|---|
| 3,468,443 | 9/1969 | Marcus | 215/1 C |
| 3,598,270 | 8/1971 | Adomaitis | 215/1 C |
| 3,720,339 | 3/1973 | Khetani | 215/1 C |
| 3,870,181 | 3/1975 | Sincock | 215/1 C |
| 3,871,541 | 3/1975 | Adomaitis | 215/1 C |
| 3,935,955 | 2/1976 | Das | 215/1 C |
| 3,973,693 | 8/1976 | Brocklehurst | 220/70 X |

*Primary Examiner*—Donald F. Norton

*Attorney, Agent, or Firm*—H. Lawrence Smith; Joseph E. Kerwin; William A. Dittmann

[57] ABSTRACT

A container formed of synthetic resinous material having a bottom structure the outer surface of which comprises a central concavity and a convex heel, the heel surrounding the concavity and merging therewith and with the container sidewall. A plurality of hollow convex ribs, distributed in a symmetrical array, interrupt the outer surface of the concavity and merge smoothly therewith, each rib extending longitudinally in the direction of the heel and downwardly from an inner portion of the concavity. The wall of the bottom structure generally decreases in thickness progressively from the innermost point of the concavity to the sidewall.

5 Claims, 9 Drawing Figures

RIBBED BOTTOM STRUCTURE FOR PLASTIC CONTAINER

BACKGROUND OF THE INVENTION

This invention relates to bottom structures for containers, and more particularly, to improved bottom structures for plastic bottles of the type suitable for containing liquids under pressure such as carbonated beverages.

The bottling of carbonated beverages in plastic presents a number of problems, many of which arise in connection with the base or bottom structure of the bottle. As is discussed with greater particularity hereinbelow, mere duplication in plastic of tranditional glass bottom configurations is unsatisfactory because of the tendency of plastics to creep or become distorted under pressure, especially in the presence of the elevated temperatures which may be encountered during shipment and storage. Such distortion may alter the shape and dimensions of traditional bottom configurations to the extent that the level of liquid within the bottle falls below the fill line, thereby threatening customer acceptance or satisfaction, and the bottle may become a so-called rocker; that is, it may become unstable on a horizontal surface.

On the other hand, it is frequently desirable that the inner and outer shapes and dimensions of plastic bottles approximate those of glass bottles of the same capacity so that they may be handled by existing equipment and, in certain instances, assist customer identification of the particular product they contain. In any event, they should be aesthetically attractive.

A plastic bottle, when filled with a carbonated beverage and capped, must be able to withstand both the impact of falling from at least a moderate height onto a hard surface and the precipitous rise in internal pressure which accompanies the impact. While this requirement also affects selection of materials and bottle-forming techniques, it is an extremely important consideration in the contemplation of bottom design.

Finally, the optimum bottom structure is one which not only meets the foregoing criteria but which may be readily formed with an economy of material, without unduly expensive or elaborate equipment, and without intricate or additional manufacturing steps.

One of the most common bottom structures employed in glass bottles of the type intended to contain beverages under pressure is the so-called champagne bottom, the outer surface of which comprises a central concavity and a convex heel surrounding the concavity and merging therewith and with an end portion of the container sidewall. The lowermost points of the heel lie in a common plane to support the bottle in an upright position on a horizontal surface. Such a bottom configuration in the appropriate thickness may be wholly satisfactory in glass because of the rigidity of that material.

When the champagne bottom is translated to a thin-walled plastic container, however, the central concavity has a tendency to evert to under internal pressure, thereby rendering the bottle unstable on a horizontal surface. Even if outright eversion does not occur, internal pressure tends to cause the bottom structure to "roll out" or flex outwardly at the juncture of the concavity and the surrounding heel, whereby the concavity becomes shallower and the radial dimension of the heel is altered. This, in turn, causes an increase in the volume enclosed by the bottle and a corresponding lowering of the level of liquid contained.

Various expedients intended to alleviate these conditions have been proposed heretofore. Among them are the bottom structures disclosed in U.S. Pat. No. 3,468,443, issued Sept. 23, 1969 to P. Marcus. The wall of each of these prior bottom structures is shown to be of a uniform thickness no greater than that of the sidewall. In fact, that portion of the wall which defines the central concavity is described as a "web." To rigidify this web a plurality of external ribs interrupt the outer surface of the concavity and extend outwardly therefrom. The ribs are distributed in a symmetrical array, each rib extending longitudinally in the direction of the heel from an inner portion of the concavity. Even with the rigidity provided by the ribs, some degree of eversion or flexure is expected, because a further, central depression is necessary to ensure that the center of the web will remain spaced from a flat supporting surface. It is to be noted that the ribs of the prior patent intersect the outer surface of the concavity in rather abrupt angles and that the ribs are solid, the latter feature requiring a substantial amount of material. Perhaps more importantly, the solid ribs present a further problem as follows.

Plastic containers, particularly plastic bottles having narrow necks, are conveniently and economically formed by the well-known blow-molding process. Briefly, a preform or parison at an appropriate temperature is received or enclosed in a mold cavity having the form of the finished container and the preform is expanded until its outer surface conforms to the cavity surface. Expansion is effected by creating an imbalance in the respective pressures acting on the inner and outer surfaces of the parison, as by introducing a gas under pressure to the interior of the parison or by drawing a vacuum about its exterior. In the case of the solid ribs of the prior patent, the corresponding grooves in a blow-mold surface would be extremely difficult if not impossible to fill with the material of the preform.

SUMMARY OF THE INVENTION

A container formed in accordance with the present invention also includes a plurality of ribs interrupting the outer surface of the concavity and distributed in a symmetrical array, each rib extending longitudinally in the direction of the heel from an inner portion of the concavity. In addition, each rib extends downwardly from the inner portion of the concavity, whereby the outer end portion of each rib is lower than the inner end portion thereof. In accordance with the invention, the ribs are hollow. Preferably, the wall of the bottom structure generally decreases in thickness progressively from the innermost point of the concavity to the end portion of the container sidewall. More particularly, the ratio of the thickness of the bottom structure wall to the thickness of the sidewall end portion is preferably in the range of 2.0 to 4.5 at the innermost point of the concavity, 1.2 to 2.2 at an intermediate portion of the concavity between the innermost point and the heel, 1.2 to 2.2 at a longitudinally intermediate portion of each rib, and 0.9 to 2.1 at each of the lowermost points of the heel.

In preferred embodiments of the invention, the margins of each rib merge smoothly with adjacent portions of the bottom structure, and each rib is of fusiform configuration.

Other objects, features and advantages of the invention will be apparent from the ensuing description in conjunction with the accompanying drawings.

THE DRAWINGS

THE ILLUSTRATED EMBODIMENTS

Figure 1:
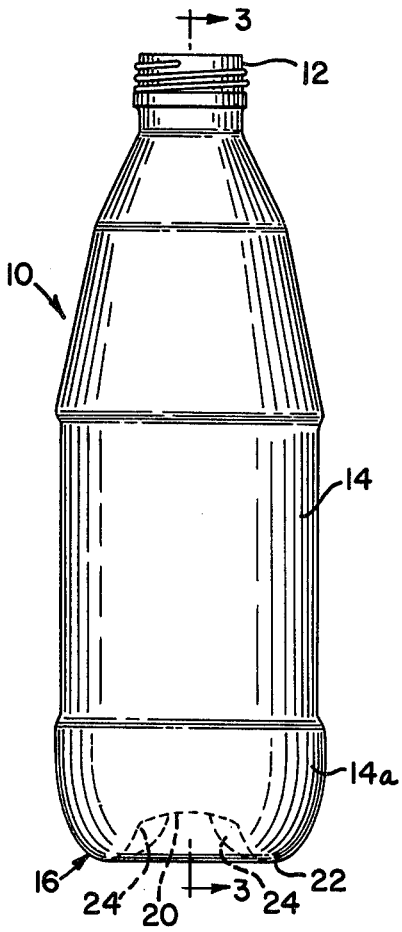
FIG. 1 is a side elevational view of a container comprising a bottle constructed generally in accordance with the invention.

Referring to FIGS. 1 to 4, a container in the form of a bottle 10 is constructed generally in accordance with the invention and is formed of a thermoplastic synthetic resinous material having gas barrier properties to a degree such that the bottle will be suitable for containing an effervescent or carbonated beverage at least throughout expected shelf time; that is to say, the period from bottling to consumption. The bottle is blow-molded from an extruded or injection-molded preform or parison and has preferably been so worked that the material is biaxially oriented.

Bottle 10 is provided with an upper neck portion 12 having any desired neck finish, such as the threaded finish shown. A sidewall 14 of any suitable form extends from the neck portion to a bottom structure, indicated generally at 16, which closes the lower end of the sidewall. An end portion **14*a*** of the sidewall adjacent to the bottom structure is preferably formed with an outer surface which is generally symmetrical about the central upright axis of the bottle, such as the cylindrical form shown, although other forms may be substituted within the purview of the invention.

The outer surface of bottom structure 16 includes a central concavity 20 surrounded by a convex annular heel 22, the heel merging at its radially inner margin with the concavity and at its radially outer margin with sidewall portion **14*a***.

Figure 3:
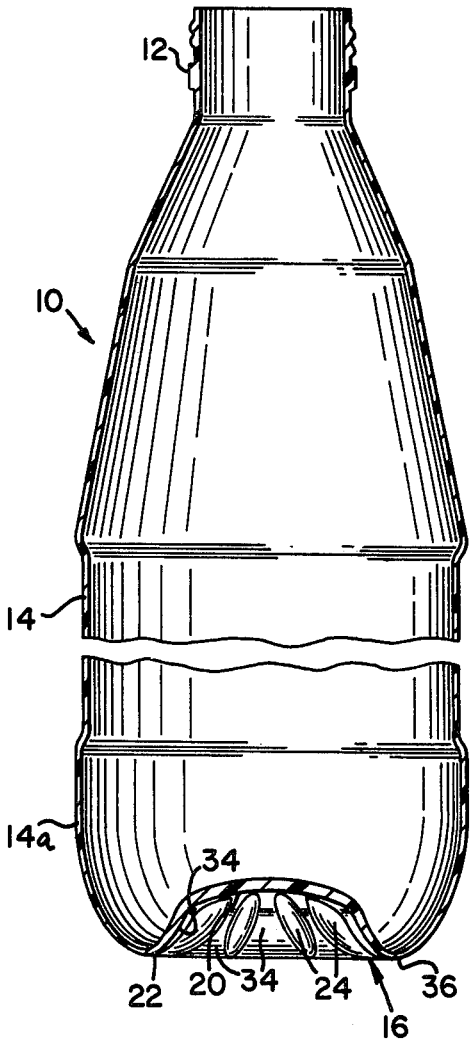
FIG. 3 is an enlarged fragmentary view of the bottle of FIG. 1 taken along the line 3—3 thereof.
Figure 4:
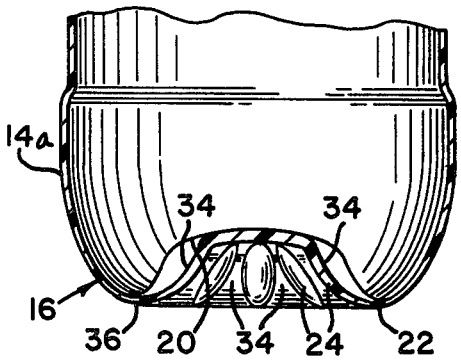
FIG. 4 is an enlarged fragmentary sectional view of the bottle of FIG. 1 taken along the line 4—4 of FIG. 2.

A plurality of ribs 24 interrupt the outer surface of concavity 20 and are distributed in a symmetrical array, each rib extending longitudinally in the direction of heel 22 and downwardly from an inner portion of the concavity. As is best illustrated in FIGS. 3 and 4, ribs 24 are preferably convex outwardly and, referring particularly to FIG. 2, they are preferably radially arrayed. While eight such ribs are shown (FIG. 2), the number may vary in accordance with the degree of rigidity to be provided and by the overall dimensions and wall thickness of the bottom structure and individual ribs.

Figure 2:
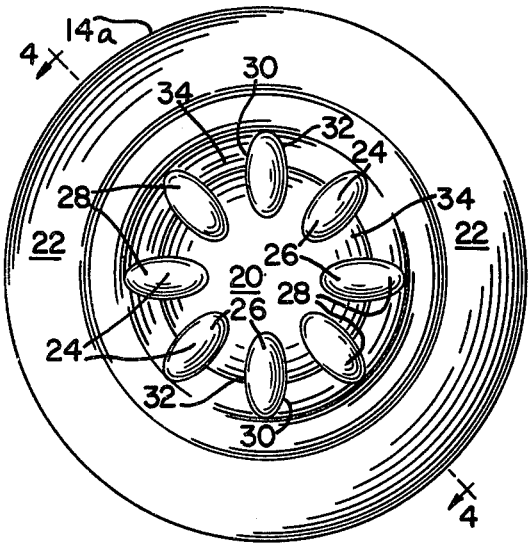
FIG. 2 is a greatly enlarged bottom plan view of the bottle of FIG. 1.

Each rib 24 has inner and outer ends 26 and 28, respectively, merging with the wall of concavity 20 the outer end of each rib being lower than the inner end thereof. Each rib also has a pair of lateral margins 30, 32 merging with adjacent portions of the wall of the bottom structure. While ribs 24 are preferably convex outwardly, as shown, they may be convex inwardly with similar effect, as might be especially useful in the case of a substantially shallow concavity. Being angularly spaced, each pair of adjacent ribs are separated from one another by a portion 34 of the wall of concavity 20, and it will be noted that these wall portions 34 are in effect internal ribs. In any event, the ribs are preferably of fusiform configuration, as shown in FIGS. 2, 3 and 4.

The lowermost points 36 of heel 22 form a support ring which lies in a plane normal to the central axis of bottle 10, whereby the bottle may be supported at points 36 on a horizontal surface in an upright position. It is not necessary that the longitudinal extent of the ribs be confined to the concavity; they may extend to and interrupt the outer surface of the heel as well. In the case of convex ribs, the lowermost points of the ribs would thus become the lowermost points of the heel. In the case of concave ribs, the ribs would simply interrupt the support ring formed by lowermost points 36 of the heel.

It will be noted that ribs 24 are hollow and, as will be described with greater particularity hereinafter, the wall of bottom structure 16 generally decreases in thickness from the innermost point of concavity 20 to sidewall end portion **14*a***. However, deviations from this progressive decrease in wall thickness are well within the purview of the invention.

Figure 5:
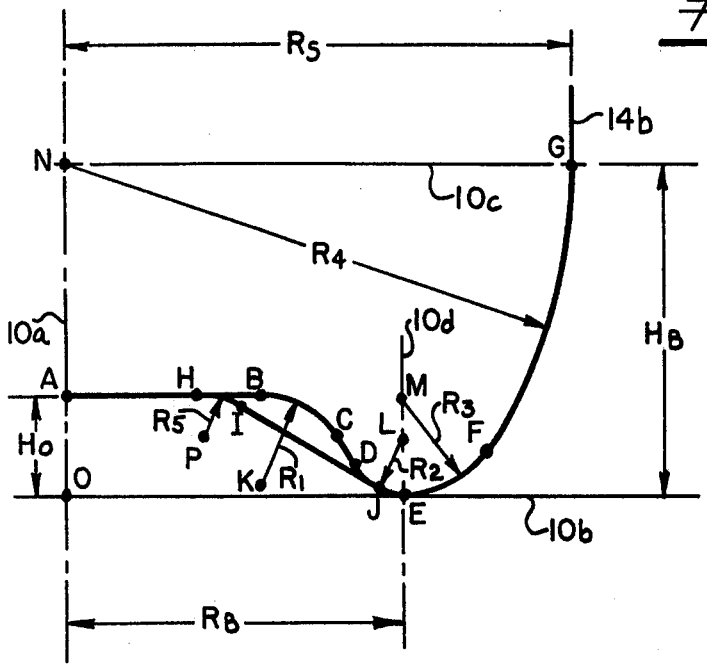
FIG. 5 is a diagrammatic representation of two radial profiles, one superimposed on the other, of a bottle bottom structure which comprises one embodiment of the invention.

FIG. 5 represents a specific embodiment of the invention in the form of two radial profiles of the outer surface of the bottom structure taken at separate angular locations. Also represented is the profile **14*b*** of the outer surface of the adjacent sidewall end portion.

More particularly, a first profile ABCDEFG extends radially between an adjacent pair of ribs from the central upright axis **10*a* of the bottle, through the lowermost point E of the heel, to sidewall profile 14*b*, and is superimposed on a second profile AHIJEFG which includes one of the ribs, the latter profile also extending radially from the axis to the sidewall profile. A line 10*b* represents the plane which contains the lowermost points E of the heel and which therefore intersects axis 10*a* at right angles therewith, the point of intersection being designated O. A second plane is represented by a line 10*c*, the latter plane marking the upper limit of the bottom structure and the lower limit of the sidewall end portion. Sidewall profile 14*b*** is shown as a straight vertical line, indicating that the sidewall end portion is cylindrical in this instance.

The outer radial dimension $R_S$ of the sidewall of the bottle will in many cases be established to coincide with the equivalent dimension of existing bottles of the same capacity, whereby to facilitate customer identification and accommodate existing filling and handling equipment. The dimension $R_B$, which is the radial distance between axis **10*a*** and lowermost point E of the heel, is selected to provide an acceptable degree of upright stability when the bottle is supported on a horizontal surface but is significantly smaller than dimension $R_S$ for a reason which will be made clear hereinafter.

In the embodiment of FIG. 5, the maximum depth $H_O$ of the concavity is shallow relative to dimension $R_S$ and therefore the central portion of the concavity profile has a flat configuration. More particularly, a segment AB of the concavity profile is a straight line normal to axis 10*a*. So that the concavity will merge smoothly with the convex heel, a shallow S-curve BCDE is provided which consists of segments BC, CD and DE. Segment BC is a concave arc tangent to segment AB at point B and having a radius of curvature $R_1$ originating at a point K. Segment DE is a convex arc having a radius $R_2$, which is substantially smaller than radius $R_1$ and which originates at a point L. Segment CD is a straight line tangent to arcs BC and DE at points C and D, respectively.

It is to be noted that the term "arc" is used throughout this specification in its special sense as meaning a continuous portion of a circle; that is, a curved line having a constant radius of curvature. The word "curve", on the other hand, is used as a generic term, and a curve may therefore comprise a composite line which includes a plurality of arcs, or arcs and straight lines, arranged in a continuous tangential series.

The radial profile of the heel comprises a curve EFG consisting of segments EF and FG. Segment EF is a convex arc tangent to arc DE at point E and having a radius of curvature $R_3$ originating at a point M. Segment FG is a convex arc tangent to arc EF and sidewall profile 14*b* at points F and G, respectively. Arc FG has a radius $R_4$ originating at a point N.

The length of radius $R_4$ is established at a relatively large value, in this instance equal to radial dimension $R_S$ of the sidewall profile, to enhance impact resistance when the bottle is dropped with axis 10*a* inclined from the vertical. To accommodate curve EFG, dimension $R_B$ is significantly smaller than dimension $R_S$, as mentioned hereinbefore.

Centers of curvature L and M of arcs DE and EF, respectively, are located on a line 10*d* which is parallel with axis 10*a*. With this construction arcs DE and EF are tangent to one another at the lowermost point E of the heel for optimum impact strength when the bottle is dropped with axis 10*a* in a vertical position.

Maximum flexural stresses due to internal pressure can be expected to arise in the vicinity of curve HBCDJ, point H being an intermediate point of segment AB, and point J being an intermediate point of arc DE. Accordingly, the rib profile HIJ subtends the curve HBCDJ. Specifically, the rib profile comprises an arc HI tangent to segment AB at point H and having a radius of curvature $R_5$ originating at a point P, and a straight-line segment IJ tangent to arcs HI and DE at points I and J, respectively. With this construction the end margins of the rib are merged smoothly with adjacent portions of the bottom structure to avoid stress concentrations.

Figure 5A:
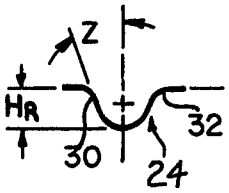
FIG. 5A is a diagrammatic representation of a transverse profile of an element represented in FIG. 5.

FIG. 5A represents; the transverse profile of the rib at its maximum depth $H_R$. It will be noted that lateral margins 30 and 32 merge smoothly with adjacent portions of the bottom structure, again to avoid stress concentrations. A line drawn tangent to the curve of each lateral margin describes an angle Z with the vertical.

Figure 6:
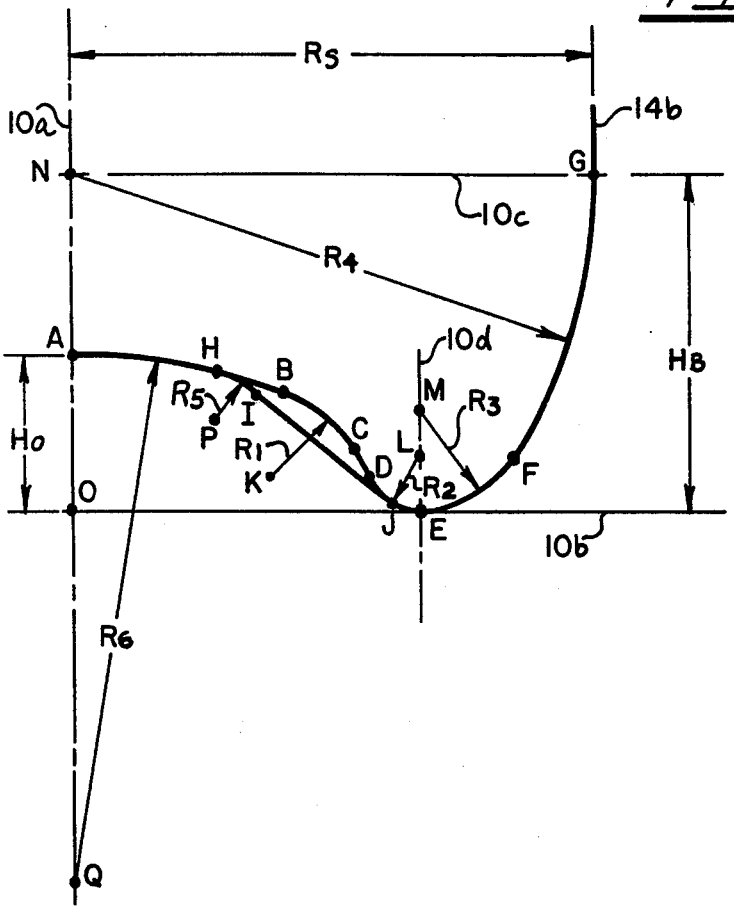
FIG. 6 is a diagrammatic illustration similar to FIG. 5 but representing a bottle bottom structure which comprises another embodiment of the invention.

In FIG. 6, which represents an alternative embodiment of the invention, reference characters identical to the reference characters of FIG. 5 identify elements and quantities corresponding to those of FIG. 5.

Figure 6A:
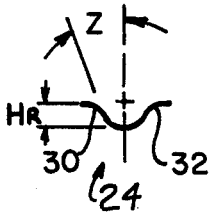
FIG. 6A is a diagrammatic representation of a transverse profile of an element represented in FIG. 6.

In the construction shown in FIG. 6, the maximum depth $H_O$ of the cavity has been increased relative to dimension $R_S$ over that represented in FIG. 5 and, instead of being a straight line, segment AB is an arc tangent to curve BC at point B and having a relatively large radius $R_6$ originating at a point Q located on axis 10*a*. Accordingly, the central portion of the concavity is a segment of a sphere, the sphere being commonly recognized as the optimum pressurebearing surface. As is best seen in FIG. 6A, the rib of the embodiment of FIG. 6 can thus be formed with a shallower maximum depth $H_R$ than that of the embodiment of FIG. 5, rigidity being a function of rib depth.

Figure 7:
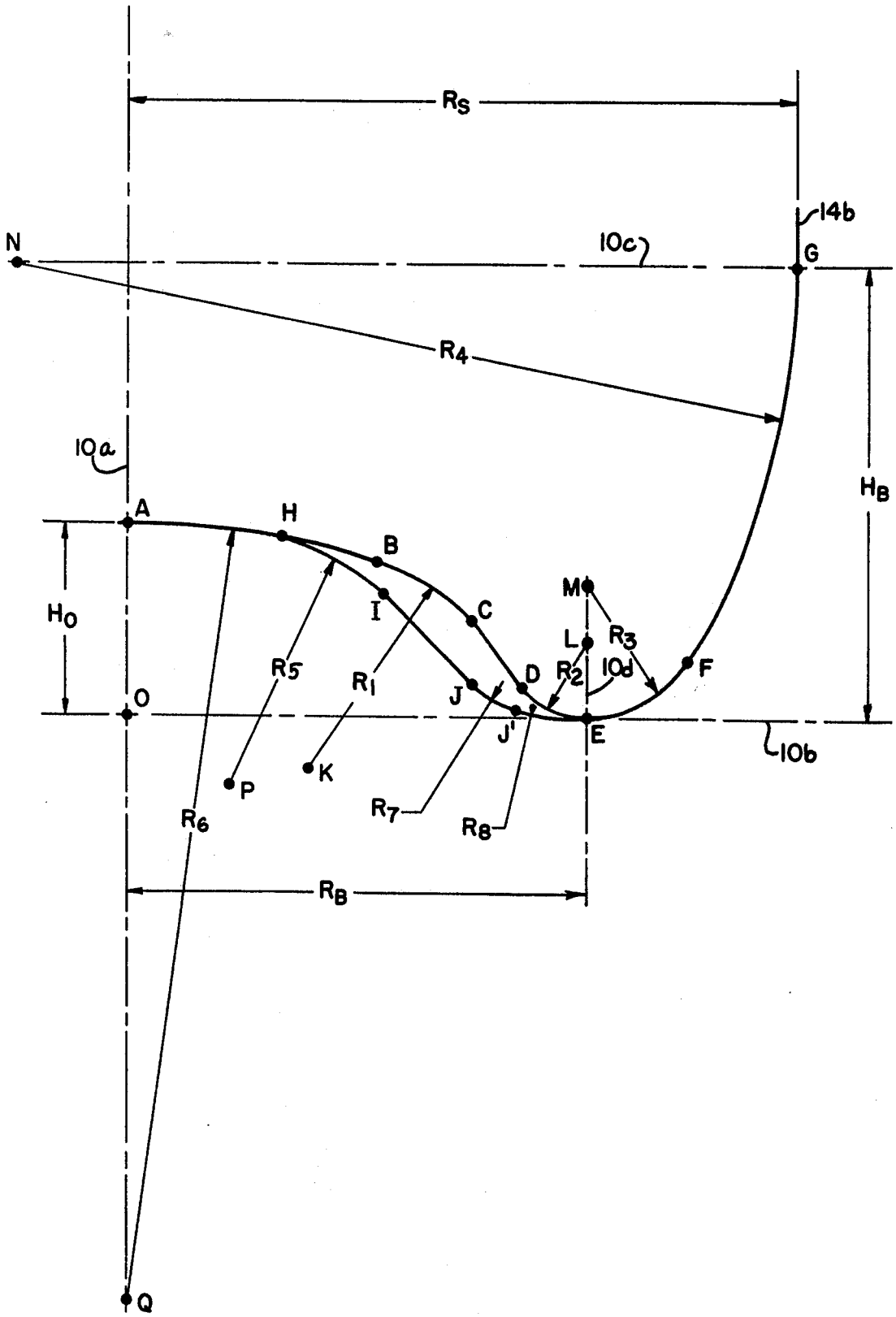
FIG. 7 is a diagrammatic illustration similar to FIG. 5 but representing a bottle bottom structure which comprises yet another embodiment of the invention.

In FIG. 7, which represents yet another embodiment of the invention, reference characters identical to the reference characters of FIG. 6 identify elements and quantities corresponding to those of FIG. 6. Here, the maximum depth $H_O$ of the concavity is once again relatively shallow with reference to dimension $R_S$. However, as in FIG. 6, segment AB is an arc having a relatively large radius $R_6$. To increase the effective length of the rib, the radius $R_5$ of arc HI has been substantially lengthened, and a curve JJ'E has been added to the rib profile. More particularly, a convex arc JJ' is tangent to straight-line segment IJ at point J and has a radius $R_7$. A second arc J'E is tangent to arcs JJ' and EF at points J' and E, respectively, and has a radius $R_8$. (The lengths of radii $R_7$ and $R_8$ and their points of origin have not been indicated to avoid unnecessarily cluttering the drawing.) Further, the length of radius $R_4$ of arc FG has been increased to a value greater than the radial dimension $R_S$ of the sidewall.

The embodiments represented in FIGS. 5, 6 and 7 are but three of many which may be realized in accordance with the invention and which may vary with variable requirements, various materials, and various forming processes and equipment. To cite one example, the profile of the concavity may include elements or segments of cones, frustums of cones, ellipsoids, parabolas, hyperbolas, catenaries, ogives, or the like, as well as combinations of these and other geometric forms. It will be recognized that the design of specific bottom structures in accordance with the teaching of the invention is readily adaptable to well-known computer programming procedures.

As stated hereinbefore, it is preferable that the wall of the bottom structure generally decrease in thickness progressively from the innermost point of the concavity to the end portion of the container sidewall.

More specifically, referring to FIGS. 5, 6 and 7, the ratio of the thickness of the wall of the bottom structure to the thickness of the sidewall is preferably within the ranges indicated in the following table at the locations listed:

TABLE

| Location | Range of Ratio of Bottom Wall Thickness to Sidewall Thickness |
|---|---|
| Point A | 2.0 - 4.5 |
| Point H | 1.8 - 3.0 |
| Segment BC | 1.2 - 2.2 |
| Segment IJ | 1.2 - 2.2 |
| Point E | 0.9 - 2.1 |
| Segment EF | 0.9 - 2.1 |
| Point G | 0.9 - 1.2 |

With variation in thickness within these ranges, the walls of the concavity and of the ribs will be relatively thick to provide rigidity whereas in the vicinity of the curves JEF and (FIG. 7) J'EF, the wall will be relatively thin to provide a flexible, resilient hinge-like structure to distribute and dissipate forces of impact. Further, these characteristics will be realized without excessive use of material.

While the invention has been particularly described in connection with certain specific embodiments thereof, it is to be understood that this is by way of illustration and not of limitation, and the scope of the appended claims should be construed as broadly as the prior art will permit.

What is claimed is:

1. A container having a sidewall and a bottom structure closing the container at an end portion of the sidewall, the outer surface of the bottom structure comprising a central concavity, a convex heel surrounding the concavity and merging therewith and with the sidewall end portion, the lowermost points of the heel lying in a common plane, and a plurality of ribs interrupting the outer surface of the concavity and distributed in a symmetrical array, each rib extending longitudinally in the direction of the heel and downwardly from an inner portion of the concavity, whereby the outer end portion of each rib is lower than the inner end portion thereof, characterized by the feature that the ribs are hollow.

2. A container according to claim 1, wherein the ratio of the thickness of the wall of the bottom structure to the thickness of the sidewall end portion is in the range of i. 2.0 to 4.5 at the innermost point of the concavity,
ii. 1 2 to 2.2 at an intermediate portion of the concavity between said innermost point and the heel,
iii. 1.2 to 2.2 at a longitudinally intermediate portion of each rib, and
iv. 0.9 to 2.1 at each of said lowermost points of the heel.

3. A container according to claim 1, wherein the margins of each rib merge smoothly with adjacent portions of the bottom structure.

4. A container according to claim 1, wherein each rib is convex outwardly relative to the bottom structure.

5. A container according to claim 1, wherein each rib is of fusiform configuration.

* * * * *